United States Patent [19]

Higaya et al.

[11] 4,181,425

[45] Jan. 1, 1980

[54] APPARATUS FOR CLEANING PHOTOSENSITIVE MEMBER

[75] Inventors: Toshiaki Higaya, Kawasaki; Kenzo Ariyama, Tokyo, both of Japan

[73] Assignee: Ricoh Company, Ltd., Tokyo, Japan

[21] Appl. No.: 821,946

[22] Filed: Aug. 4, 1977

[30] Foreign Application Priority Data

| | | | |
|---|---|---|---|
| Aug. 11, 1976 | [JP] | Japan | 51-95595 |
| Aug. 11, 1976 | [JP] | Japan | 51-95597 |
| Aug. 12, 1976 | [JP] | Japan | 51-108141[U] |

[51] Int. Cl.[2] ..... G03G 21/00; B21B 45/02

[52] U.S. Cl. ..... 355/15; 15/256.52; 101/425

[58] Field of Search ..... 355/3 R, 15; 118/652; 15/1.5, 256.51, 256.52, 308; 101/425

[56] References Cited

U.S. PATENT DOCUMENTS

| | | | |
|---|---|---|---|
| 351,314 | 10/1886 | Delmage | 15/1.5 R |
| 3,074,086 | 1/1963 | Remer | 15/1.5 R |
| 3,580,673 | 5/1971 | Yang | 355/15 |
| 3,722,018 | 3/1973 | Fisher | 15/1.5 R |
| 3,807,853 | 4/1974 | Hudson | 355/15 |
| 3,848,994 | 11/1974 | Fraser | 355/15 |
| 3,950,092 | 4/1976 | Zoltner | 118/652 X |
| 4,101,215 | 7/1978 | Fottner et al. | 355/15 |

*Primary Examiner*—Fred L. Braun

*Attorney, Agent, or Firm*—Cooper, Dunham, Clark, Griffin & Moran

[57] ABSTRACT

An apparatus for cleaning a photosensitive member comprising a cleaning roller formed of foamed resin which contacts the member and a pressure plate held in compressing abutment against the roller so as to extend in the direction of its forward rotation at the point of contact therebetween. Any residual powder on the photosensitive member is removed by the roller and retained in the pores formed in the roller surface. The powder retained in the pores is expelled by the resilience of the compressed surface of the roller as it is restored upon release from the pressure plate. The cleaning apparatus also comprises a system for recovering powder that is expelled from the roller surface, and a rotating helical coil disposed in a conveyance path for preventing solidification of the powder and for facilitating its conveyance.

9 Claims, 5 Drawing Figures

APPARATUS FOR CLEANING PHOTOSENSITIVE MEMBER

BACKGROUND OF THE INVENTION

The invention relates to an apparatus for cleaning a photosensitive member, employed in the electrophotographic process, and more particularly for removal of any residual powder attaching to the surface of such a member subsequent to the image transfer step.

In the electrophotographic process, an electrostatic latent image formed on a photosensitive member is developed with a powder material, called a toner, which can be electrostatically attracted, thereby producing a powder image which is then transferred onto a copy sheet such as an ordinary paper to provide an ultimate image. When the transfer step is completed, a portion of the powder material which has not been transferred remains on the surface of the photosensitive member. It is necessary to remove such residue before recycling the photosensitive member in the process. A cleaning apparatus for the photosensitive member is used to this end. In the prior art, the removal of such residual powder has been accomplished by using a cleaning apparatus which incorporates a cylindrical brush, called a fur brush, formed of rabbit fur. However, the current trend is toward the use of a roller formed of foamed resin instead of such a fur brush.

A roller formed of foamed resin has a high wiping effect due to the unevenness formed by the pores in the surface, and is flexible enough to avoid damage to the photosensitive member. In addition, such a roller has an abrasion resistance, and is inexpensive. However, a difficulty is experienced with such rollers in that powder wiped off by the roller finds its way into the surface pores and cannot be easily removed therefrom. Therefore, when a cleaning apparatus incorporating such a roller is to be used, there must be provided some means which removes powder from the roller.

To provide such means, Japanese Patent Publication No. 20227/1974 and Japanese Laid-Open Utility Model Application No. 69942/1975 disclose the use of a recovering roller to which an electrical bias is applied and which is disposed in contact with the resin roller for absorbing powder from the latter. Alternatively, Japanese Patent Publication No. 37547/1975 discloses the use of a fur brush in contact with the resin roller to scrape the powder off the latter. However, the use of the bias results in a complex arrangement while the use of the fur brush results in a dispersion of scattering of the powder, causing a contamination of the overall system.

SUMMARY OF THE INVENTION

In accordance with the invention, there is provided a cleaning apparatus including a cleaning roller formed of a highly resilient material such as foamed resin. The cleaning roller scrapes any residual powder from the surface of the photosensitive member, and the scraped powder is driven or expelled by a pressure plate which is disposed in abutment against the roller so as to extend in the direction of its forward rotation. Because the roller material such as foamed resin has elasticity, it is compressed when disposed in abutment with the pressure plate. During the rotation of the cleaning roller, the compressed portion of the roller surface is impulsively restored as it is disengaged or released from the pressure plate, thereby expelling the powder by the resilience which has been retained in the pores in the surface of the cleaning roller. The cleaning apparatus also comprises a recovering roller which is disposed adjacent the pressure plate for receiving powder that is expelled by the action of the latter. In addition, the cleaning apparatus comprises means for charging the surface of the recovering roller to a degree sufficient to attract the toner. The residual powder principally comprises the toner, which is at the electrical potential of substantially zero when it passes by the neutralizing station of the process, so that when the surface of the recovering roller is sufficiently charged, the powder expelled by the action of the pressure plate can be caused to adhere to the surface of the recovering roller in a reliable manner. In addition, the apparatus may include a rotatable helical coil disposed in a path for conveying removed powder for preventing solidification of the removed powder and for facilitating the conveyance.

Therefore, it is an object of the invention to provide an apparatus for cleaning a photosensitive member which includes a cleaning roller formed of foamed resin or like resilient material and which facilitates the removal of powder from the cleaning roller.

It is another object of the invention to provide such apparatus which includes means for recovering powder that is removed by the cleaning roller.

It is a further object of the invention to provide such apparatus including means which assures the removal of the powder from the cleaning roller.

It is still another object of the invention to provide such apparatus which includes means for preventing the solidification of and facilitating the conveyance of removed powder.

DESCRIPTION OF PREFERRED EMBODIMENTS

Figure 1:
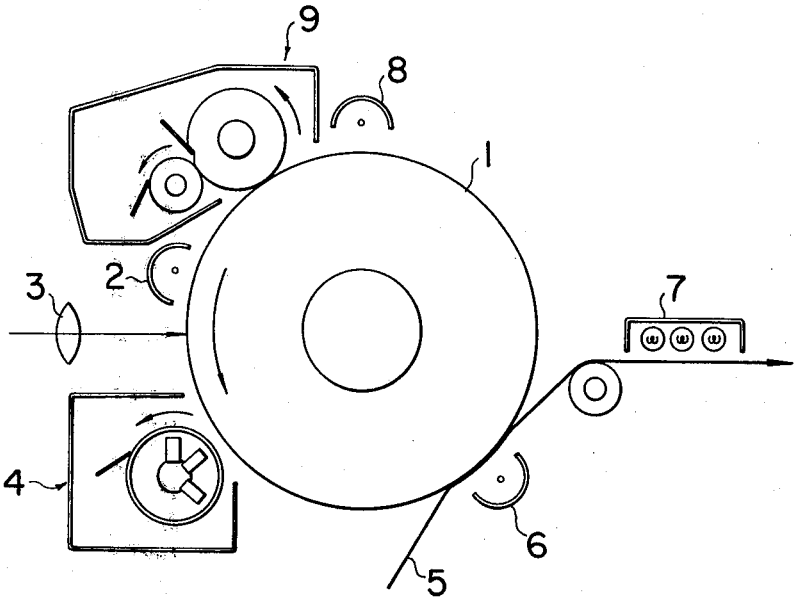
FIG. 1 is a schematic view showing an example of an electrophotographic system which includes a cleaning apparatus for a photosensitive member in accordance with the present invention.

Referring to FIG. 1, there is shown a photosensitive member in the form of a drum 1 having a photoconductive insulating layer on its surface. The drum 1 is adapted to be driven in the direction indicated by an arrow, and is initially charged by a corona discharger 2 before it is imagewise exposed to the image of an original through an exposure system 3. The charge on the drum surface is neutralized in the exposed region and is retained in the dark region which is free from the influence of the exposure. In this manner, an electrostatic latent image corresponding to the image of the original is formed on the drum surface. The latent image is converted into a visual image by a developing unit 4. In the example shown, the developing unit 4 is of a magnetic brush type wherein a magnetic brush of powder developer comprising a toner and a carrier is formed and maintained on the surface of a developing roller under the influence of the magnetic attraction exerted by the magnets contained internally within the roller. By rotating the developing roller, the magnetic brush is brought into contact with the latent image, which electrostatically attracts the toner in the magnetic brush, thus producing a visual image. The developed powder image on the drum is brought into superimposed relationship with a copy sheet 5 during a further rotation of the drum 1. The copy sheet 5 is charged from the rear side by a corona discharger 6. The electric charge applied to the copy sheet 5 is great enough to overcome the electrostatic attraction of the latent image upon the powder image, thus transferring the powder image onto the copy sheet 5. Subsequently, the copy sheet 5 is separated from the drum surface, and the powder image fixed to the sheet in a fixing unit 7. Subsequent to the transfer step, the drum surface is exposed to a corona discharge by an a.c. corona discharger 8, whereby the surface charge of the drum which maintains residual powder thereon is neutralized, weakening the attraction upon the residual powder. Thus, the residual powder can be removed from the drum surface by a cleaning unit 9.

Figure 2:
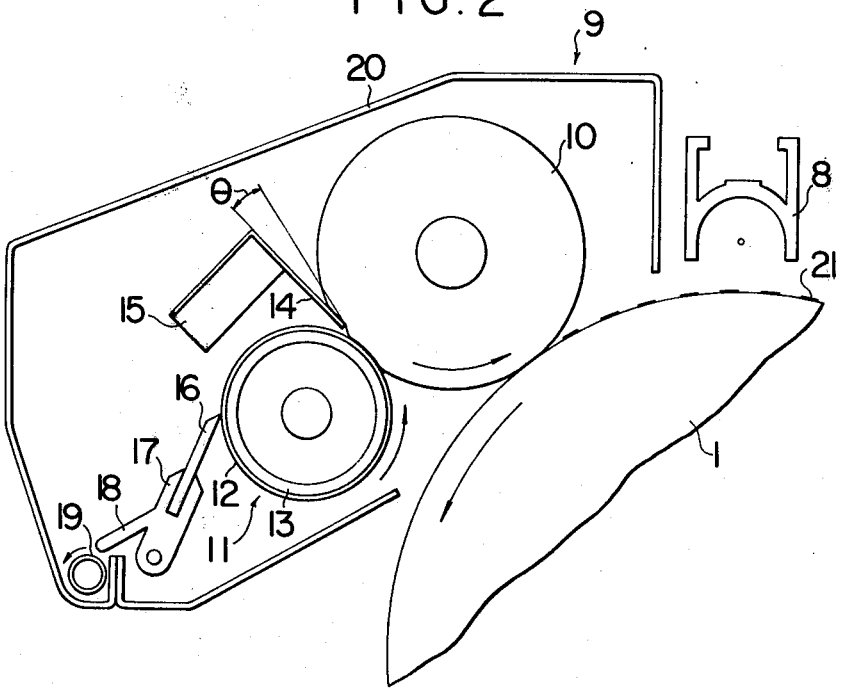
FIG. 2 is a schematic view in greater detail of one embodiment of the invention.

Referring to FIG. 2, which shows the cleaning apparatus 9 according to the invention in greater detail, it will be seen that it comprises a cleaning roller 10 formed of foamed urethane and disposed in gentle contact with the drum surface. The roller 10 is rotated in a direction to run in the opposite direction from the direction of rotation of the drum 1 at the point of contact therebetween, and may be driven at a peripheral speed of 250 mm/sec when the peripheral speed of the drum 1 is 140 mm/sec. The apparatus also comprises a recovering roller 11 which is disposed close to or in gentle contact with the surface of the cleaning roller 10. The recovering roller 11 comprises a metallic roller 13 having a surface coating 12 of Teflon (registered trademark of Du Pont Company). The recovering roller 11 is rotated at substantially the same speed as the cleaning roller 10 but in a direction such that these rollers move in opposite directions at the point of contact therebetween or where they are most closely located to each other. A pressure plate 14 is disposed in forced abutment against a region of the surface of the cleaning roller 10 which immediately precedes the point of contact with or minimum spacing from the recovering roller 11, as viewed in the direction of rotation of the roller 10. It will be noted that the pressure plate 14 is disposed to extend generally in the same direction as the direction of rotation of the cleaning roller 10, but it is preferred that the pressure plate 14 forms an angle $\theta$ between 10° and 60° with respect to the tangent at the point on the surface of the cleaning roller 10 engaged by the end of the plate. The pressure plate 14 is supported by a support member 15, and though it may comprise either a rigid or resilient body, it is preferred that it have a relatively small thickness. In the present embodiment, a stainless steel plate having a thickness on the order of 0.5 mm is used.

A scraping blade 16 is disposed on the opposite side of the recovering roller 11 with its free end placed in gentle contact with the surface thereof in a direction which is opposite from the direction of rotation of the roller 11. The scraping blade 16 is carried by a holder 17 which is integrally formed with a guide plate 18 for conveying the removed powder. A rotatable conveyor coil 19 is disposed below the free end of the guide plate 18 for conveying the powder in a horizontal direction to the exterior of the cleaning apparatus 9. The entire apparatus 9 is enclosed in a cover 20.

In operation, the adhesion of the residual powder 21 to the surface of the drum 1 is diminished by the a.c. corona discharger 8, and powder is then scraped by the cleaning roller 10 to be retained in the pores formed in the surface thereof. As the cleaning roller 10 rotates it carries the surface region in which the removed toner is retained to a position corresponding to the free end of the pressure plate 14, at which point the surface region is compressed by the pressure plate 14. At the next moment when the surface region has moved past the free end of the pressure plate 14 and is released therefrom, the resilience of the roller material causes the surface region to be restored impulsively to its original configuration, and at the same time expel the retained powder externally. Since the recovering roller 11 is rotating immediately adjacent the pressure plate 14, the expelled powder attaches to the surface of the recovering roller to be carried thereby onto the scraping blade 16, and thence to the guide plate 18 and conveyor coil 19, which conveys it to a given location.

In the embodiment described above, where both the rollers 10, 11 maintain the contact therebetween during their rotation, the cleaning roller 10 is triboelectrically charged to a level of about positive 2400 volts while the recovering roller 11 is charged to a negative level of the same magnitude. After passing by the neutralizing charger, the electric charge remaining on the toner is substantially reduced, so that the toner which is expelled by the pressure plate 14 toward the recovering roller 11 can be easily attracted and collected by the latter. In addition to the triboelectric charging by the cleaning roller 10, the recovering roller 11 can be charged (1) by triboelectric charging by scraping blade 16, (2) by charging with a charger, or (3) by the application of a bias voltage to the metallic roller portion. The powder remaining on the drum surface which is to be removed with the apparatus of the invention may comprise a toner in a two-component developer, or a magnetic or non-magnetic toner in a single component developer.

Where a two-component developer is used in the magnetic brush developing unit 4 as shown in FIG. 1, the carrier usually comprises an iron powder or magnetic powder. The carrier having a relatively large particle diameter forms the tuft of a brush under the magnetic influence of the magnets, and a toner having a relatively small particle diameter is attached to the brush by triboelectricity which results from the friction with the carrier. For example, when an iron powder is mixed with a resin toner which is situated at a higher rank in the triboelectric series, the toner is charged to the positive polarity and the iron powder to the negative polarity. The developing process takes place by rubbing the carrier- and-toner brush against the drum surface on which an electrostatic latent image is formed. Where the latent image is formed by a negative charge, the positively charged toner can be easily attached thereto while the negatively charged iron powder is repelled. However, if the adhesion between the iron powder and the toner is greater than the force of repulsion, the iron powder attaches to the latent image while it is attached by the toner. In this manner, there may be a small amount of iron powder admixed with the developed powder image. When the cleaning roller is used to remove any residual powder from the drum surface subsequent to the transfer of the powder image onto a copy sheet, the powder attaching to the cleaning roller must be sufficiently recovered, otherwise the iron powder may be brought into contact with the drum surface again, thereby damaging it. In particular, when the cleaning roller is formed of foamed resin, recovery of the removed powder is difficult to achieve. In accordance with the invention, a recovery means such as shown in FIG. 3 is provided to this end.

Figure 3:
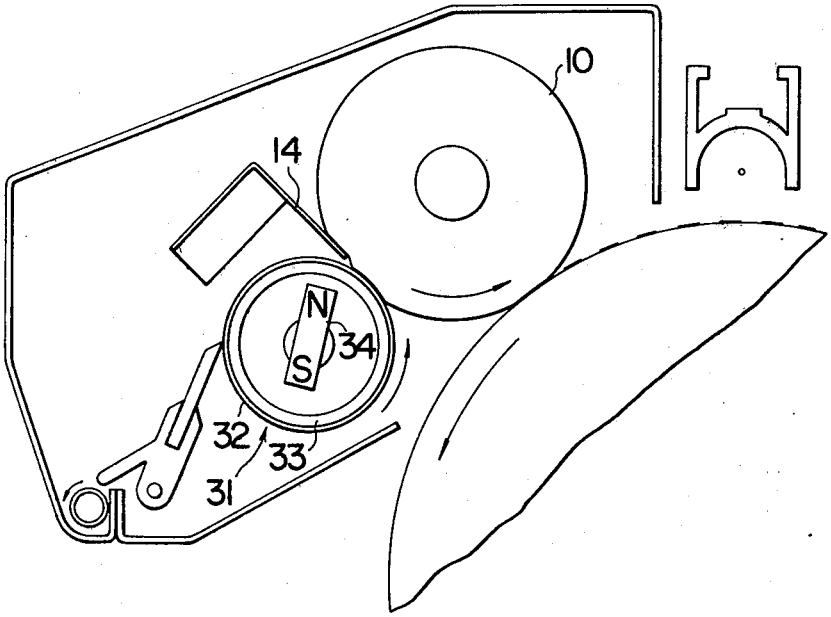
FIG. 3 is a schematic view of another embodiment of the invention.

FIG. 3 shows another form of the recovering means. Specifically, there is shown a recovering roller 31 which comprises a rotatable metallic roller 33 having a surface coating 32 of Teflon. A stationary magnet 34 is disposed inside the metallic roller 33. The roller 31 is rotated substantially at the same speed as the cleaning roller 10, but in a direction so that they move in opposite directions at the point of contact therebetween. The orientation of the magnet 34 is chosen such that one of its poles is situated near the circumference of the cleaning roller 10 at a point immediately preceding the point of contact with the recovering roller 31. The pressure plate 14 has its free end disposed in forced abutment against the surface of the cleaning roller 10 at a corresponding position. With this arrangement, the iron powder contained in the removed powder which is expelled by the pressure plate 14 is attracted by the recovering roller 31 under its magnetic influence, together with the toner. The recovering roller 31 may be entirely formed as a magnet.

The powder is removed from the recovering rollers 11, 31 shown in FIGS. 2 and 3 by means of scraping blade 16. The use of the scraping blade for removal generally tends to produce a solidification of removed powder during its conveyance. To avoid such solidification, it has been the practice heretofore to impart oscillations to removed powder in its path of conveyance for disintegrating it. An alternative has been to dispose the scraping blade in a nearly vertical position for contact with the cleaning roller. However, imparting oscillations to the removed powder results in a scattering or dispersion of the powder, thereby producing an adverse influence upon the overall system. On the other hand, the vertical disposition of the scraping blade imposes a restriction on the layout of other devices.

Figure 4:
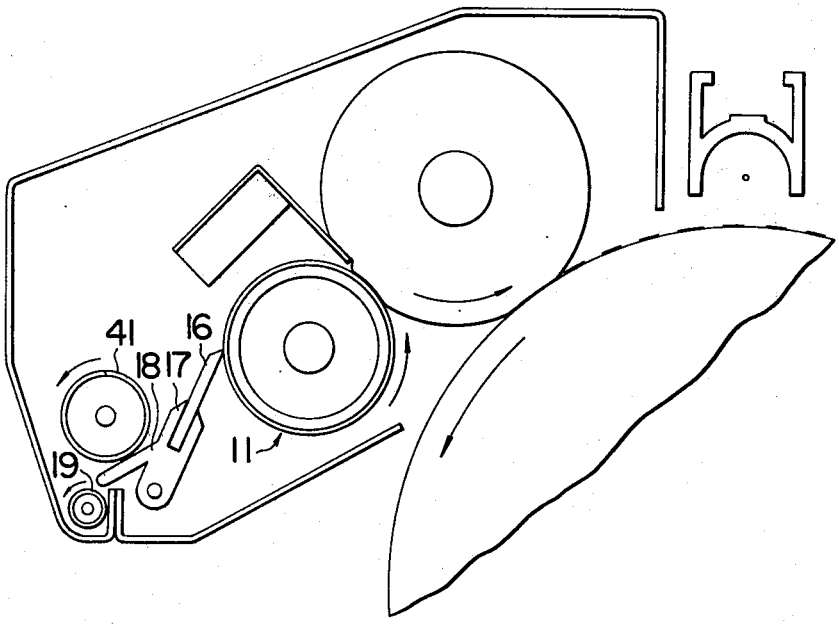
FIG. 4 is a schematic view of a further embodiment of the invention.
Figure 5:
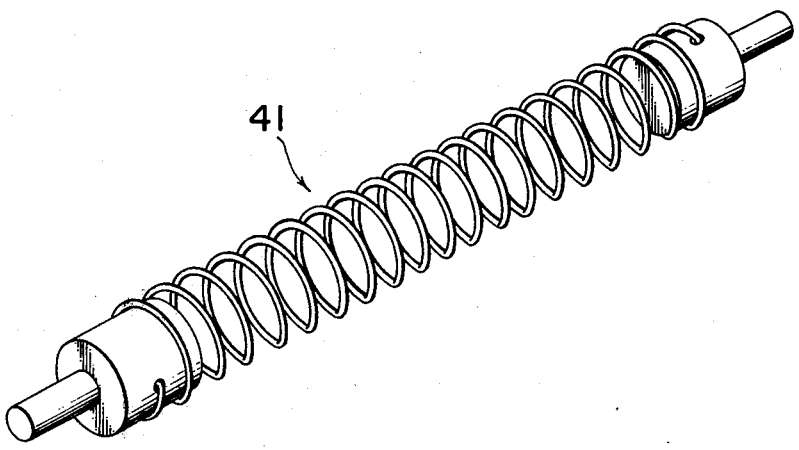
FIG. 5 is a perspective view of a helical coil of the type used in the embodiment shown in FIG. 4.

In accordance with the invention, the cleaning apparatus includes a rotatable helical coil disposed in a path of conveyance of powder that is removed by the scraping blade, for preventing a solidification of removed powder and facilitating its conveyance. Referring to FIG. 4, the scraping blade 16 is disposed on the side of the recovering roller 11 which is away from the cleaning roller, and has its free end disposed in gentle contact with the surface of the recovering roller 11 in a direction opposite from the direction of rotation thereof. The scraping blade 16 is carried by a holder 17 which is integrally provided with a guide plate 18 for conveying removed powder. A rotatable auxiliary helical coil 41 (see FIG. 5) of a large diameter is disposed above the guide plate 18 and is closely spaced therefrom while a rotatable helical coil 19 of a reduced diameter is disposed below the free end of the guide plate 18. The recovery of powder from the recovering roller 11 by the scraping blade 16 tends to solidify the powder. However, the solidified powder is disintegrated by the helical coil 41 while moving down the guide plate 18. As it falls down from the tip of the guide plate 18, the powder is laterally conveyed by the helical coil 19 to a given position for recovery.

In carrying out the present invention, a number of modifications and changes may be made in the embodiments described above. By way of example, melton cloth (Molleton for tradename) or a fur brush having a hair length on the order of 1 to 1.5 mm may be substituted for the foamed resin material of the cleaning roller with similar effect. Both of these materials exhibit a high resilience. Where the drum runs at a high peripheral speed, the single cleaning roller used will have to be operated at a higher peripheral speed, causing a scattering of the toner. This can be avoided by providing a plurality of cleaning rollers. In addition, the drum, the cleaning and recovering rollers may be replaced by endless belts. Therefore it is intended that the scope of the invention be solely defined by the appended claims.

What is claimed is:

1. An apparatus for cleaning a photosensitive member to remove any residual powder which may remain attached to the surface of the photosensitive member after a transfer step, the apparatus comprising:

a cleaning means having a nonbristled pore-containing surface with a high restoring resilience and rotatably disposed in contact with the surface of the photosensitive member for cleaning residual powder therefrom; and a pressure means, comprising a plate having an end portion extending in the same direction as the rotation of the cleaning means and disposed against the surface of the cleaning means downstream from the point of contact between said photosensitive surface and said cleaning means in the direction of rotation of the cleaning means for compressing the surface of said cleaning means at a point of contact therebetween, in such manner that the residual powder is expelled from the pores in the surface of said cleaning means by the resilient restoration of said surface after compression.

2. An apparatus according to claim 1 in which the surface of the cleaning means is formed of foamed resin.

3. An apparatus according to claim 1 in which the surface of the cleaning means comprises melton cloth.

4. An apparatus for cleaning a photosensitive member to remove any residual powder which may remain attached to the surface of the photosensitive member after a transfer step, the apparatus comprising:

a cleaning means having a non-bristled pore-containing surface with a high restoring resilience and rotatably disposed in contact with the surface of the photosensitive member for cleaning residual powder therefrom;

a powder recovering means rotatably disposed immediately adjacent a point on the surface of the cleaning means for receiving powder expelled therefrom; and a pressure plate having an end disposed in forced abutment against the surface of the cleaning means at a point which immediately precedes said point of adjacency between the cleaning means and the recovering means in the direction of rotation of the cleaning means, the pressure plate end compressing the surface of the cleaning means and extending in a forward direction with respect to the direction of rotation of the cleaning means, in such manner that the residual powder is expelled from the pores in the surface of said cleaning means by the resilient restoration of said surface after compression.

5. An apparatus according to claim 4 in which the recovering means includes means for the charging thereof.

6. An apparatus according to claim 4 in which the recovering means comprises means for producing a magnetic attraction.

7. An apparatus as in claim 4 wherein the cleaning means comprises a roller and the pressure plate forms an angle in the range from 10° to 60° with the tangent to the point on the surface of the roller abutted by the end of the pressure plate.

8. An apparatus for cleaning a photosensitive member to remove any residual powder which may remain attached to the surface of the photosensitive member after a transfer step, the apparatus comprising:

a cleaning means having a surface formed of foamed resin and rotatably disposed in contact with the surface of the photosensitive member for cleaning residual powder therefrom;

a powder recovering means rotatably disposed immediately adjacent a point on the surface of the cleaning means for receiving powder expelled therefrom;

a pressure plate having an end disposed in forced abutment against the surface of the cleaning means at a point which immediately precedes said point of adjacency between the rotating cleaning means and the recovering means in the direction of rotation of the cleaning means, the pressure plate end compressing the surface of the cleaning means and extending in a forward direction with respect to the direction of rotation of the cleaning means, whereby the residual powder is expelled from the surface of said cleaning means by the resilient restoration of said surface after compression;

a scraping means arranged in contact with the surface of the recovering means for removing the powder received thereon;

a guide means located adjacent the scraping means for guiding and transporting the powder removed therefrom; and a rotatable helical coil disposed above the guide means in close proximity thereto for dispersing the powder transported thereby.

9. An apparatus as in claim 8 further comprising another rotatable helical coil for transporting powder received from said guide means.

* * * * *